US010821451B1

(12) United States Patent
McLeod et al.

(10) Patent No.: US 10,821,451 B1
(45) Date of Patent: Nov. 3, 2020

(54) MEDIA PROTECTION SYSTEM FOR LINE DEMARCATION

(71) Applicant: Bead Pro LLC, Loveland, CO (US)

(72) Inventors: Thomas John McLeod, Loveland, CO (US); Brian Ross Miller, St. Paul, MN (US); Steven Victor Hartz, Loveland, CO (US)

(73) Assignee: BEAD PRO LLC., Loveland, CO (US)

( * ) Notice: Subject to any disclaimer, the term of this patent is extended or adjusted under 35 U.S.C. 154(b) by 97 days.

(21) Appl. No.: 16/019,486

(22) Filed: Jun. 26, 2018

Related U.S. Application Data

(60) Provisional application No. 62/525,747, filed on Jun. 28, 2017.

(51) Int. Cl.

| | |
|---|---|
| ***B05B 1/28*** | (2006.01) |
| ***E01C 23/16*** | (2006.01) |
| *E01F 9/524* | (2016.01) |
| *E01C 23/22* | (2006.01) |

(52) U.S. Cl.
CPC ..... *B05B 1/28* (2013.01); *E01C 23/16* (2013.01); *E01C 23/22* (2013.01); *E01F 9/524* (2016.02)

(58) Field of Classification Search
CPC ..... B05B 1/28; B05B 13/00; B05B 13/005; E01C 23/16; E01C 23/166; E01C 23/22; E01C 23/243
See application file for complete search history.

(56) References Cited

U.S. PATENT DOCUMENTS

| | | | |
|---|---|---|---|
| 3,057,273 | A | 10/1962 | Wilson |
| 4,319,717 | A | 3/1982 | Hofmann |
| 4,518,121 | A | 5/1985 | Smith |
| 6,511,259 | B1 | 1/2003 | Khieu et al. |
| 7,654,770 | B2 | 2/2010 | Hall et al. |
| 2009/0208287 | A1 | 8/2009 | Rouse et al. |

FOREIGN PATENT DOCUMENTS

| | | | |
|---|---|---|---|
| EP | 0560719 | A1 | 9/1993 |
| FR | 2874942 | A1 | 3/2006 |

*Primary Examiner* — Steven O Douglas
(74) *Attorney, Agent, or Firm* — Vedder Price P.C.

(57) ABSTRACT

This invention is method to protect secondary media from the environmental conditions that exist while performing line demarcation. Particularly, this invention relates to the protection of dry media as it is applied to previously applied, wet media. More particularly, this invention relates to the protection of reflective glass beads as they are applied to freshly applied wet paint.

16 Claims, 6 Drawing Sheets

MEDIA PROTECTION SYSTEM FOR LINE DEMARCATION

DESCRIPTION

FIELD OF THE INVENTION

This invention relates to the field of roadway construction, and more specifically, roadway painting.

BACKGROUND OF THE INVENTION

Public safety regarding transportation systems is an annual challenge for all DOTs. With line demarcation a mandatory expense as well as a federal safety requirement, contractors are looking for alternatives to standard line marking practices to help reduce cost, material and time loss. Today's striping trucks and hand-held equipment are more sophisticated than ever before giving us the utmost control over material output. Common practices in the line marking industry have evolved from paint pressure pots, to airless hydraulic sprayers, to trucks with computerized systems that perfectly measure quantities and pressures on the fly, and come equipped with advanced guidance systems, 3 man operations, and material transfer technologies. With all this improved technology, the reflective glass bead systems are lacking in innovation while standard bead application practices often underestimate the loss of materials due to environmental conditions. The conventional methods of applying reflective media involve the use of both pressurized and gravity fed applications with little regard for the environmental side effects of glass media application. In both application methods, the media is deflected/dispersed by a unit that sits above the ground plane, leaving the media vulnerable to any air movement such as passing traffic, overspray, pressure, application speeds, and wind conditions. The objective of the present invention is to minimize costly media overshoots and combat adverse environmental conditions, which would greatly improve today's bead application rates while reducing cost and harmful environmental side effects.

SUMMARY OF THE INVENTION

The present invention is a media protection apparatus which consists of shielding reflective media as it exits a spray unit until the material imbeds itself in a previously sprayed, wet substrate.

The media is further controlled by easily accessible, external dials, which sharpen the media output pattern to widths determined by the outside edges of the paint line while eliminating operator interference of the media application.

BRIEF DESCRIPTION OF THE DRAWINGS

A clear understanding of the key features of the invention summarized above may be had by reference to the appended drawings, which illustrate the method and system of the invention, although it will be understood that such drawings depict preferred embodiments of the invention and, therefore, are not to be considered as limiting its scope with regard to other embodiments which the invention is capable of contemplating. Accordingly.

DETAILED DESCRIPTION

Figure 1:
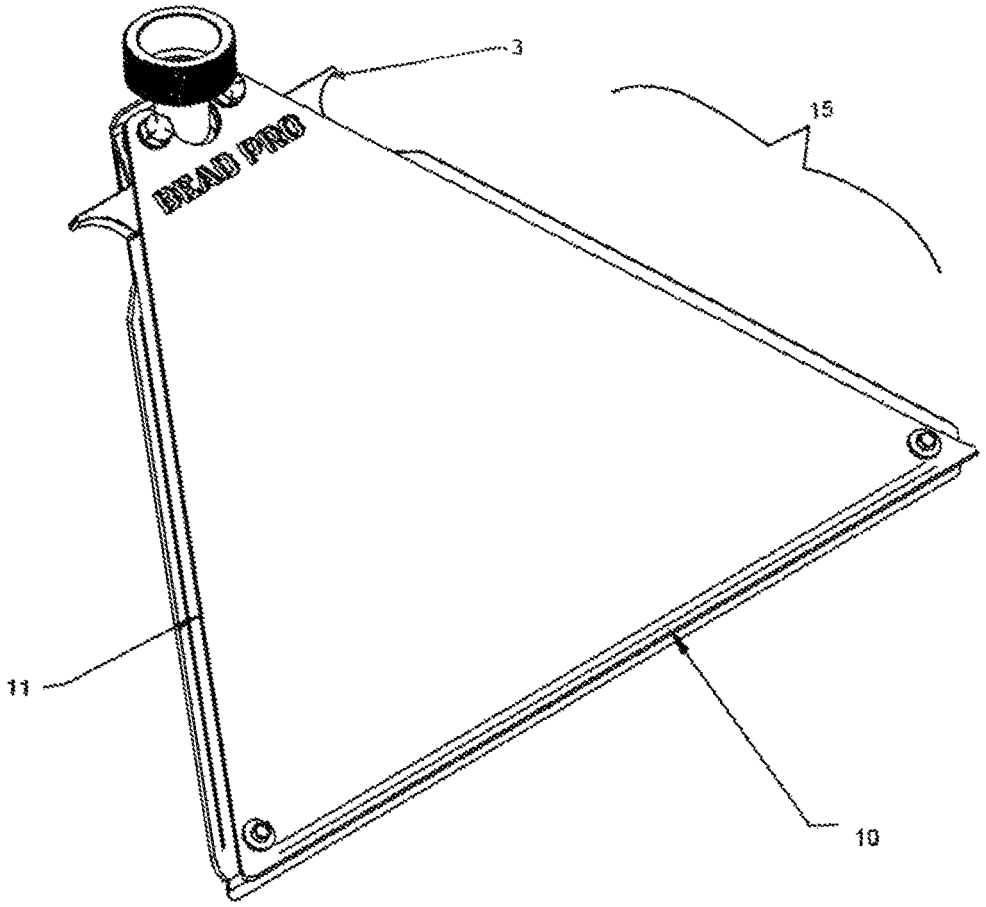
FIG. 1 is an illustration showing a perspective view of the shield and dial apparatus.
Figure 2:
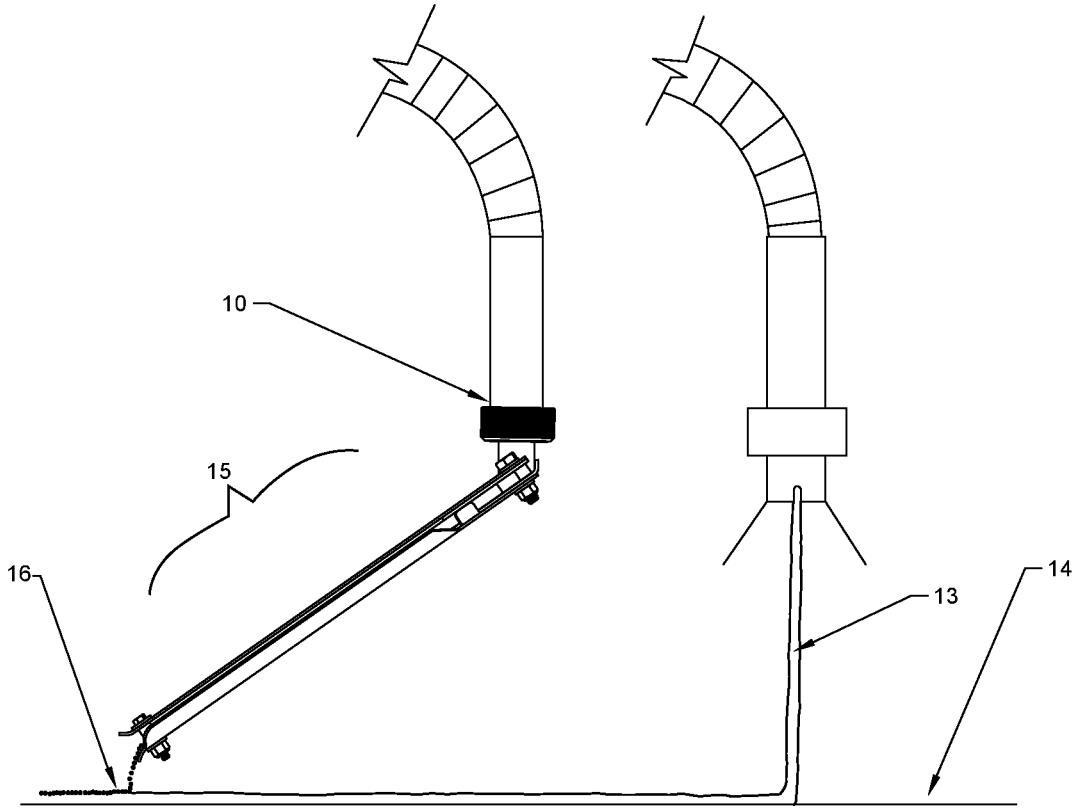
FIG. 2 shows the side view of the spray system.
Figure 3:
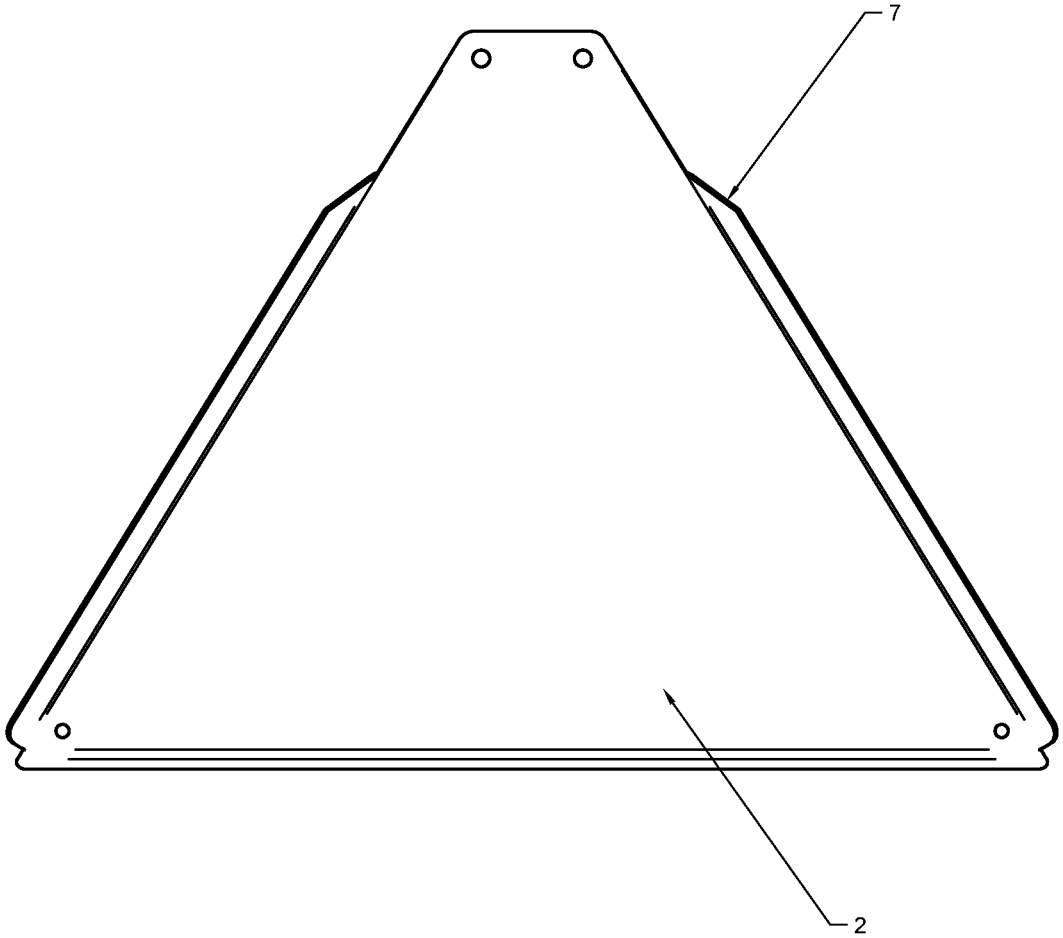
FIG. 3 depicts the lower portion of the apparatus showing the side and bottom wings.
Figure 4:
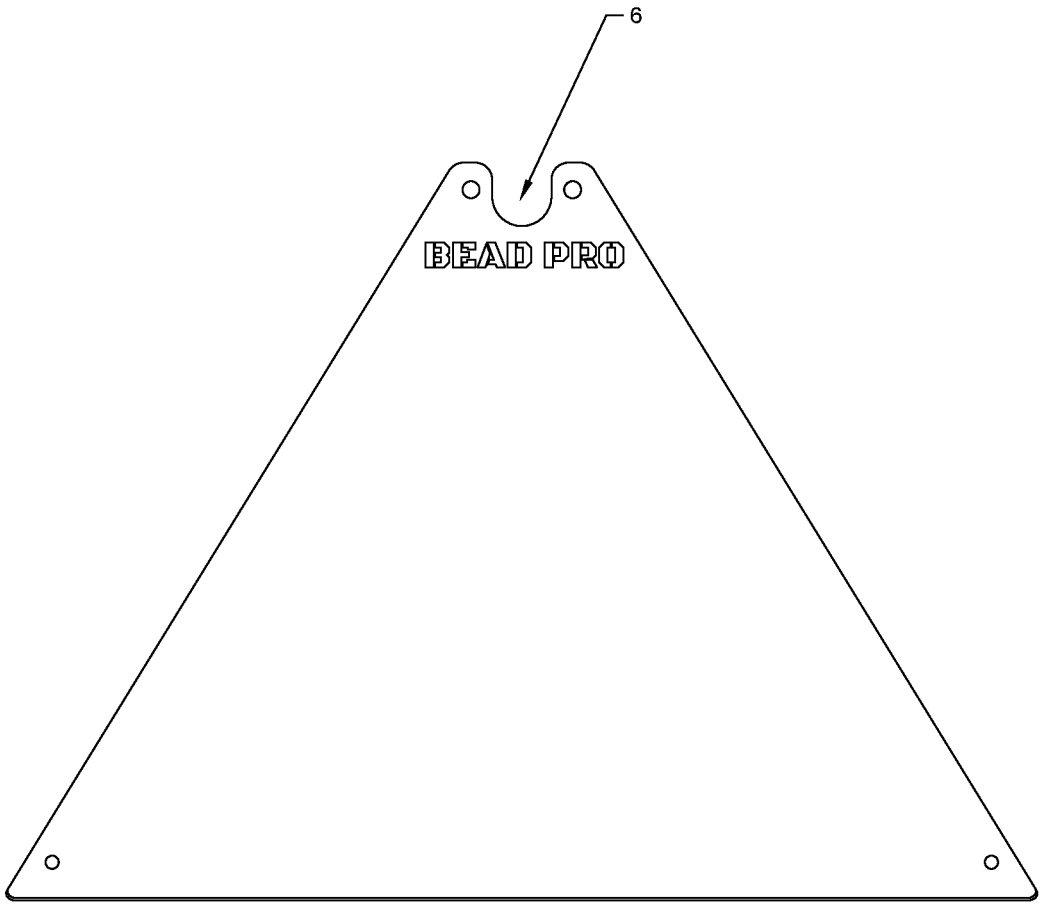
FIG. 4 depicts the upper portion of the apparatus showing the cutout for the bead gun deflector.
Figure 5:
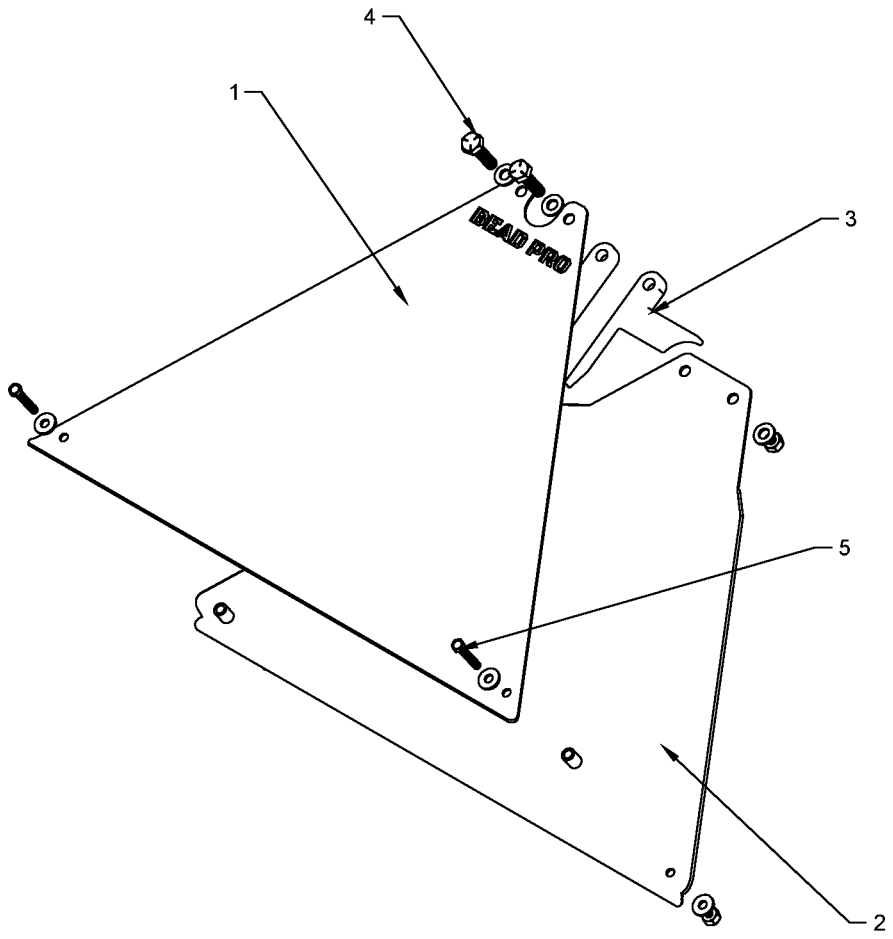
FIG. 5 is and illustration depicting the exploded view of the apparatus.
Figure 6:
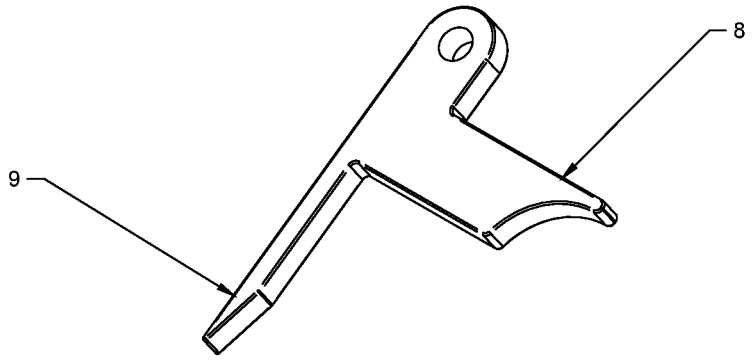
FIG. 6 depicts the precision control dial.

The present invention is a media protection system that guards secondary media from the high-pressure emissions of a primary spray system as well as windy environmental affects on by encasing the media output by one or more shields. The top shield (1) can be made of steel, aluminum or plastic and can be opaque or clear so the operator can confirm that the media is being sprayed. The preferred embodiment of the shield would be a one-piece unit that slips over the existing bead deflecting unit (10) which comes as a standard part of existing bead gun assemblies. FIG. 2 shows a side view of the primary and secondary spray guns with a shield unit (15) with a top plate (1), the bottom plate (2), and the external dial (3) that is attached to the existing bead deflector (10). The two plates create a channel (12) for the reflective media (16) to travel through on its way to the paint (13) that has been previously sprayed on the ground (14) below the shield unit (15). The open sides (11) allow for pressure equalization between the high pressure in the channel and the low pressure outside of the shield. FIG. 3 shows the wings on the bottom plate that extend off of the shield plate and are angled to protect the channel (11) from winds that hit the shield perpendicular to the direction of spraying machine. The wings are essential to ensure that the channel is protected in 360 degrees. FIG. 4 shows the top plate, which has a cutout so that the shield assembly can mount on the existing, universal bead deflector which screws to the end of the media spray gun (17). FIG. 5 represents a potential embodiment of the shield system assembly noting the use of the bead deflector hardware to connect the shield to the deflector. The preferred embodiment is a unibody shield and deflector in one. FIG. 6 shows a detail view of one the externally accessible dial. The dial handle (8) is manipulated to move the guiding arm (9). The guiding arm moves in and out to aim the media depending on the conditions as the beads leave the shield.

The invention claimed is:

1. A protection apparatus for use with a media distributing system having an opening through which media is expelled, the protection apparatus comprising:

a top shield with a cutout located proximate a first end thereof;

a bottom shield separated from the top shield by a channel, wherein a first wing extends from a first side of said bottom shield and a second wing extends from a second side of said bottom shield located opposite said first side;

a first external dial comprising a guiding arm proximate the first side of the bottom shield, the first guiding arm configured to direct the media through the channel, wherein a first dial handle extends outwardly from the first guiding arm; and a second external dial comprising a guiding arm proximate the second side of the bottom shield, the second guiding arm configured to direct the media through the channel, wherein a second dial handle extends outwardly from the second guiding arm;

wherein the media distribution system passes through the cutout such that the opening is located in the channel between the first guiding arm and the second guiding arm.

2. The protection apparatus of claim 1, wherein the first side of the bottom shield and the second side of the bottom shield are spaced apart from the top shield.

3. A protection apparatus for use with a media distributing system having an opening for expelling a media, the protection apparatus comprising:

a shield comprising a top portion and a bottom portion having a first side opposite second side, the shield having mounted to the media distributing system proximate the opening;

a guiding arm movably connected to the shield, wherein the guiding arm is configured to direct the media;

a first wing extending from the first side of the bottom portion towards the top portion;

a second wing extending from the second side of the bottom portion towards the top portion.

4. The protection apparatus of claim 3, wherein the top portion is separated from the bottom portion by a channel.

5. The protection apparatus of claim 4, wherein the top portion is substantially parallel to the bottom portion.

6. The protection apparatus of claim 5, wherein the top portion and the bottom portion are each trapezoidal in shape as viewed from above.

7. A protection apparatus for use with a media distributing system having an opening for expelling a media, the protection apparatus comprising;

a shield comprising a top portion separated from a bottom portion by a channel, the shield mounted to the media distributing system proximate the opening;

a guiding arm movably connected to the shield, wherein the guiding arm is configured to direct the media and, wherein at least an internal portion of the guiding arm is located inside the channel; and a dial having at least an external portion located outside the shield, wherein the dial, is operatively connected to the guiding arm.

8. The protection apparatus of claim 4, wherein the top portion further comprises a cutout and the opening is located proximate the cutout.

9. The protection apparatus of claim 8, wherein the media distribution system passes through the cutout such that the opening is located in the channel.

10. The protection apparatus of claim 9 wherein the guiding arm comprises a first guiding arm and is located in the channel, the protection apparatus further comprising a second guiding arm located in the channel and movably connected to the shield, wherein the second guiding arm is configured to direct the media.

11. The protection apparatus of claim 10, wherein the opening is located in the channel between first guiding arm and the second guiding arm.

12. The protection apparatus of claim 3, wherein the first wing and the second wing each are spaced apart from the top portion.

13. The protection apparatus of claim 3, wherein the top portion and bottom portion are formed from distinct elements and wherein the top portion is connected to and spaced apart from the bottom portion by one or more fasteners.

14. The protection apparatus of claim 13, wherein each of the one or more fasteners comprise one or more bolts, washers, and nuts.

15. The protection apparatus of claim 3, wherein each of the top portion and bottom portion is steel, plastic, or aluminum.

16. A method for controlling a spread of media expelled from a media distributing system using a protection apparatus comprising a top shield separated from a bottom shield by a channel, a guiding arm located at least partially within the channel, and a dial operatively connected to the guiding arm and located at least partially outside the channel, the method comprising the steps of:

movably attaching the guiding arm to the top shield attaching the top shield to the bottom shield;

attaching the media distributing system to the protection apparatus; and positioning the dial so as to obtain a desired spread of media.

* * * * *